US011820465B2

(12) United States Patent
Redburn

(10) Patent No.: US 11,820,465 B2
(45) Date of Patent: Nov. 21, 2023

(54) FAST HITCH DOCKING SYSTEM

(71) Applicant: Keith Redburn, Beaverton, MI (US)

(72) Inventor: Keith Redburn, Beaverton, MI (US)

( * ) Notice: Subject to any disclaimer, the term of this patent is extended or adjusted under 35 U.S.C. 154(b) by 309 days.

(21) Appl. No.: 17/241,832

(22) Filed: Apr. 27, 2021

(65) Prior Publication Data

US 2021/0331770 A1 Oct. 28, 2021

Related U.S. Application Data

(60) Provisional application No. 63/015,784, filed on Apr. 27, 2020.

(51) Int. Cl.
*B63B 21/00* (2006.01)

(52) U.S. Cl.
CPC ..... *B63B 21/00* (2013.01); *B63B 2021/001* (2013.01)

(58) Field of Classification Search
CPC ..... B63B 21/00; B63B 2021/001
See application file for complete search history.

(56) References Cited

U.S. PATENT DOCUMENTS 2,965,064 A * 12/1960 Wallace ..... B63B 21/00 114/216
3,177,839 A * 4/1965 Nolf ..... E02B 3/24 114/230.18
3,918,386 A 11/1975 McClain
4,998,497 A * 3/1991 Nelson ..... B63B 21/00 114/230.19
6,508,190 B1 * 1/2003 Norton ..... B63B 21/54 114/230.2
6,962,122 B1 * 11/2005 Bouldin, Jr. ..... B63B 21/00 114/230.17
6,991,245 B1 * 1/2006 Pate, Jr. ..... B63B 21/00 114/230.1
7,992,508 B1 * 8/2011 Norton ..... B63B 21/00 114/230.18
2011/0005453 A1 * 1/2011 Ebbenga ..... B63B 21/08 114/381
2013/0160691 A1 * 6/2013 Webb ..... E02B 3/24 114/230.17

FOREIGN PATENT DOCUMENTS

WO 2012093248 7/2012

* cited by examiner

*Primary Examiner* — S. Joseph Morano
*Assistant Examiner* — Jovon E Hayes
(74) *Attorney, Agent, or Firm* — Poznak Dyer Kanar Schefsky Thompson PLC

(57) ABSTRACT

A docking or mooring system for a boat includes a horizontal shaft mounted with respect to a structure at which docking the boat may be desired. The system also includes at least one hitch mounted forward of the bow of a boat and defining a tapering recess configured to receive the shaft. The shaft is spring biased at a predetermined height but is selectively movable vertically. The hitch includes a latching mechanism with cams that automatically engage the shaft using the forward motion of the boat.

8 Claims, 10 Drawing Sheets

FAST HITCH DOCKING SYSTEM

CROSS-REFERENCE TO RELATED APPLICATION

This application claims the benefit of U.S. Provisional Patent Application No. 63/015,784, filed Apr. 27, 2020, and which is hereby incorporated by reference in its entirety.

TECHNICAL FIELD

This disclosure relates generally to systems and methods for docking boats.

BACKGROUND

Mooring a boat typically involves the use of ropes, cables, etc. that interconnect the boat and a structure that is secured relative to the land. During the mooring process, a human manually extends the rope or cable between the boat and the mooring structure and then manually ties or otherwise connects the rope or cable to the mooring structure.

SUMMARY

According to a first aspect of the disclosure, a docking or mooring system for a boat includes a docking apparatus including a horizontal shaft mounted with respect to a structure at which docking the boat may be desired such as, but not limited to, a seawall. The system also includes at least one hitch mounted forward of the bow of a boat. The hitch includes a body with first and second arms that cooperate to define a recess therebetween. The recess has an opening and a terminal end. A latching system includes at least one cam that is rotatable about an axis and defines a peripheral surface. The peripheral surface includes a segment that is eccentric relative to the axis and that is positioned to contact the shaft when the shaft is engaged in the terminal end.

The docking or mooring system provided herein enables rapid and simplified docking or mooring of a boat by enabling forward movement of the boat to automatically connect the boat to the structure or landform. The latching system provides a very secure interconnection with between the shaft and the hitch; interaction between the eccentric surface and the shaft reduces or eliminates any relative movement between the hitch and the shaft. The docking apparatus enables any structure or landform to become a docking location, thereby providing flexibility to boaters and potentially eliminating the need to install costly docks; the boat itself functions as a floating dock.

In one embodiment, the boat includes two cylindrical receivers that rapidly and easily interconnect one or more hitches to the boat such as with one or more pins. The receivers are mounted to the underside of the deck of the boat and may also be used to attach other accessories or components to the boat, thereby providing enhanced flexibility to a boat owner.

According to a second aspect of the disclosure, a hitch assembly includes a body having first and second arms cooperating to define a recess therebetween, the recess having an opening and a terminal end. A cam member is rotatably mounted with respect to the first arm and is selectively rotatable relative to the body about an axis between a first position and a second position. The cam member has a peripheral surface with a generally planar segment and an eccentric segment. The planar segment and the eccentric segment extend further into the recess when the cam member is in the first position than when the cam member is in the second position.

According to a third aspect of the disclosure, a docking assembly includes support members mounted with respect to a structure or landform adjacent a body of water. A cylindrical shaft is supported by the support members such that the shaft is substantially horizontal. The docking assembly is configured such that movement of the horizontal shaft is substantially limited to vertical movement and movement in first and second horizontal directions within a predetermined range of movement.

The above features and advantages and other features and advantages of the present disclosure are readily apparent from the following detailed description of the best modes for carrying out the disclosure when taken in connection with the accompanying drawings.

DESCRIPTION OF THE PREFERRED EMBODIMENTS

Figure 1:
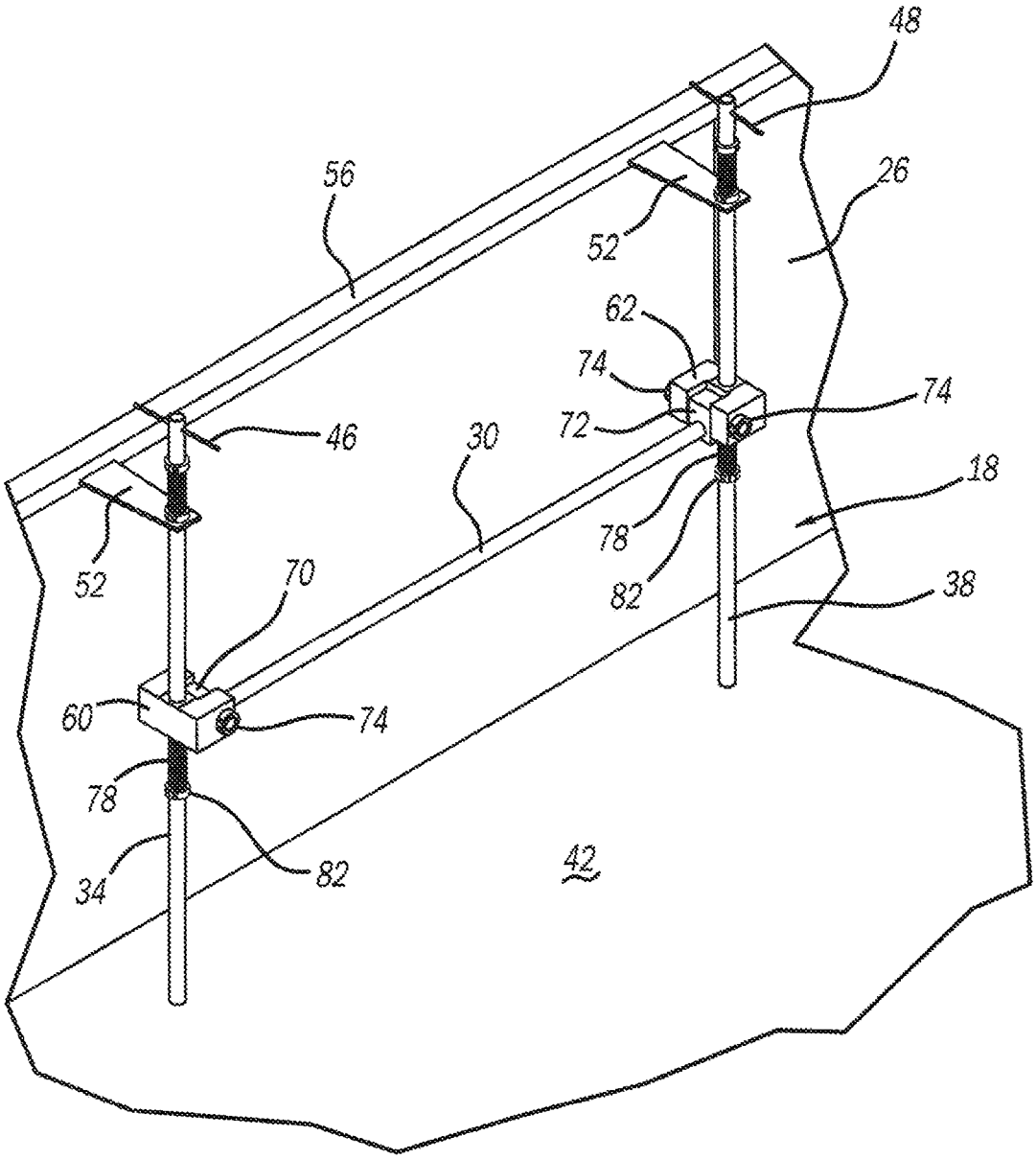
FIG. 1 is a schematic, perspective view of a first portion of a docking system including a horizontal shaft mounted relative to a seawall.

Referring to the Figures, wherein like reference numbers refer to like components throughout, a mooring system 10 for docking a boat 14 in a body of water is schematically depicted. The mooring system 10 enables rapid and simplified mooring of a boat 14. The mooring system 10 includes a first portion 18 and a second portion 22. In the embodiment depicted, the first portion 18 is secured to a feature, such as a seawall 26, such that the first portion 18 is substantially stationary. The second portion 22 is mounted to the boat 14.

As used herein, a "seawall" may be any substantially vertical structure at the edge of a body of water, including, but not limited to, lakes, rivers, and seas. It should be noted that, although the first portion 18 is mounted with respect to a seawall 26 in the embodiment depicted, the first portion 18 may be mounted with respect to any structure or landform feature at which a boat 14 may be docked or moored within the scope of the claimed invention.

Referring specifically to FIG. 1, the first portion 18 includes a horizontally-oriented, cylindrical shaft 30 that is mounted with respect to the seawall 26. More specifically, in the embodiment depicted, the shaft 30 is mounted with respect to the seawall 26 via first and second substantially vertical supports 34, 38. Each support 34, 38 extends into the bed 42 of the body of water. The lower ends of the supports 34, 38 may include threads such that the supports 34, 38 are screwed into the bed 42. In the embodiment depicted, each support 34, 38 has a respective handle 46, 48 mounted thereto to facilitate the rotation of the supports 34, 38 to screw them into the bed 42. In the embodiment depicted, the first portion 18 of the docking system 10 also includes at least one bracket 52 that interconnects the vertical supports 34, 38 and the seawall 26. A plate 56 may be secured to the top of the seawall 26 and the brackets 52 are connected to the plate 56 as shown.

Figure 2:
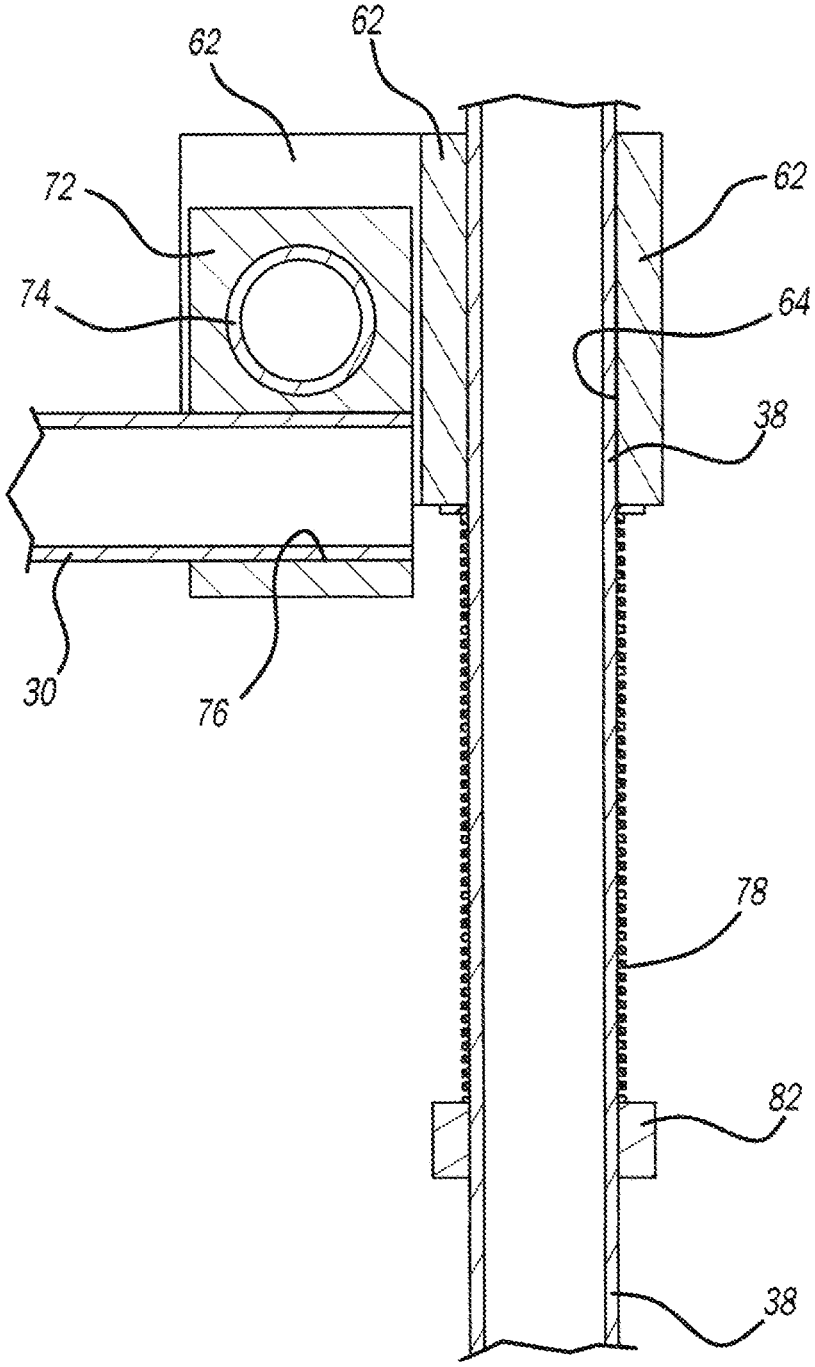
FIG. 2 is a schematic, cross-sectional, side view of a portion of the docking system of FIG. 1.

The first portion 18 includes two blocks 60, 62, each defining a respective hole 64 extending therethrough. FIG. 2 is a schematic, cross-sectional view of block 62 engaged with support 38. It should be noted that block 60 is substantially similar to block 62. Referring to FIGS. 1 and 2, block 62 is positioned with respect to the support 38 such that the support 38 extends through the hole 64 of block 62. Thus, block 62 is slidable vertically along the support 38, but physical part interference between the block 62 and the support 38 prevents or substantially limits horizontal movement of the block 62. Similarly, block 60 is positioned with respect to support 34 such that the support 34 extends through the hole 64 of block 60. Thus, block 60 is slidable vertically along the support 34, but physical part interference between the block 60 and the support 34 prevents or substantially limits horizontal movement of the block 60.

In the embodiment depicted, the first portion 18 of the system 10 includes two center blocks 70, 72 mounted to a respective one of the blocks 60, 62 via shafting 74. Each of blocks 70, 72 defines a respective hole, such as the hole 76 shown in block 72 in FIG. 2. The shaft 30 extends into the holes 76 formed in blocks 70, 72. Thus, shaft 30 is operatively connected to the blocks 60, 62, which in turn operatively connect the shaft 30 to the supports 34, 38.

In one embodiment within the scope of the claimed invention, the blocks 60, 62 are clamped to the supports 34, 38 to retain the shaft 30 at a desired height above the bed 42 or above the surface of the body of water. In the embodiment shown, and also within the scope of the claimed invention, the blocks 60, 62 are selectively movable vertically along the supports 34, 38, and thus the shaft 30 is selectively movable vertically.

More specifically, the first portion 18 includes springs 78 that bias the blocks 60, 62, and therefore the shaft 30, at a predetermined vertical position relative to the supports 34, 38. The blocks 60, 62, and therefore the shaft 30, are movable vertically by overcoming the biasing force of the springs 78. In the embodiment depicted, springs 78 are coil springs that are coiled around a respective one of the supports 34, 38 and supported by a respective member 82 mounted to the supports 34, 38. In one embodiment, members 82 are collars that are rigidly connected to a respective support 34, 38. In another embodiment, members 82 are floats, i.e., members exhibiting buoyancy in water, and are also selectively movable relative to supports 34, 38 in the vertical direction. When members 82 are floats, the position of the shaft 30 depends on the level of the surface of the body of water and will automatically change if the water level changes.

Figure 3:
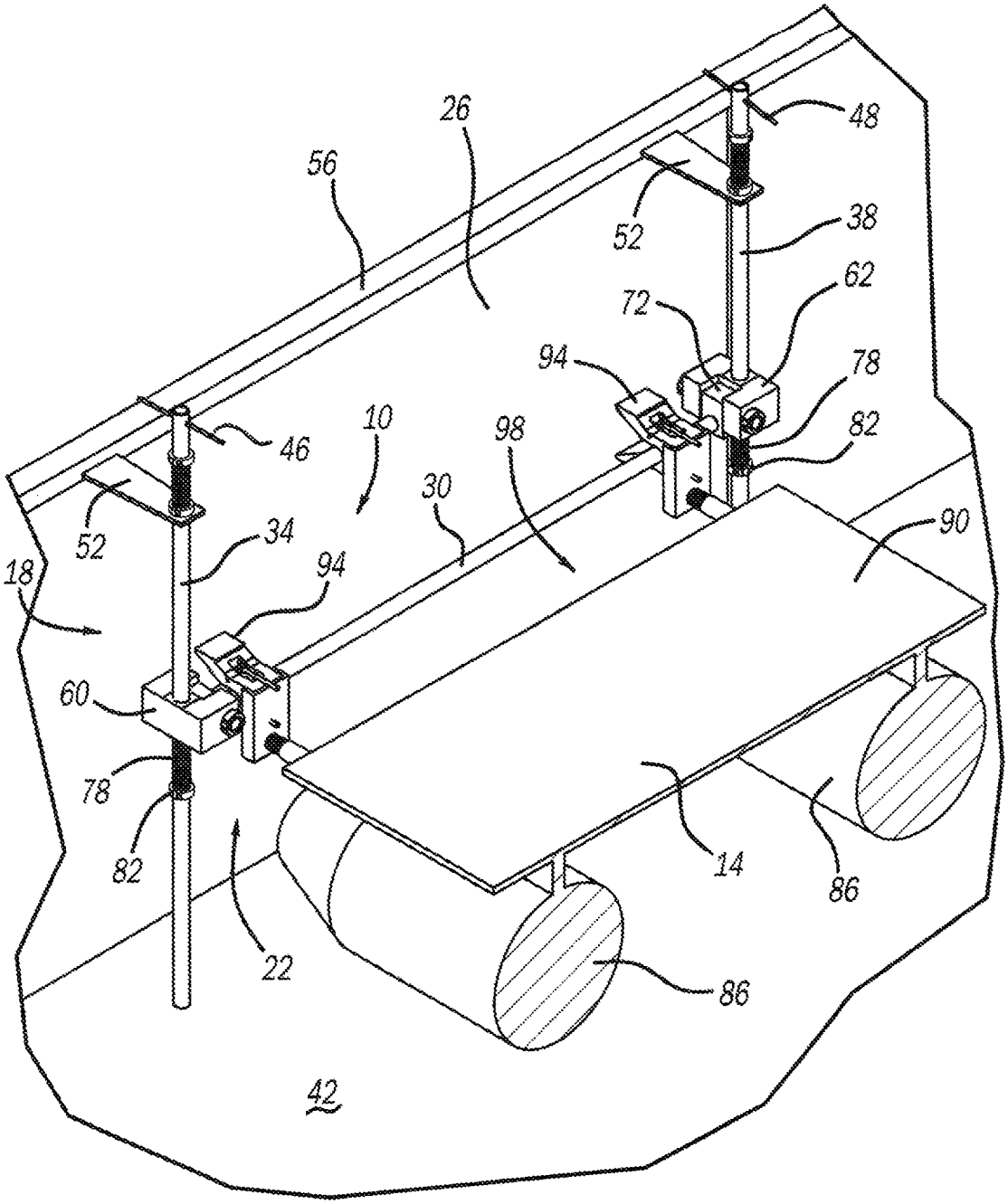
FIG. 3 is a schematic, perspective view of the first portion of the docking system engaged with a second portion of the docking system mounted to a boat to secure the boat relative to the seawall.
Figure 4:
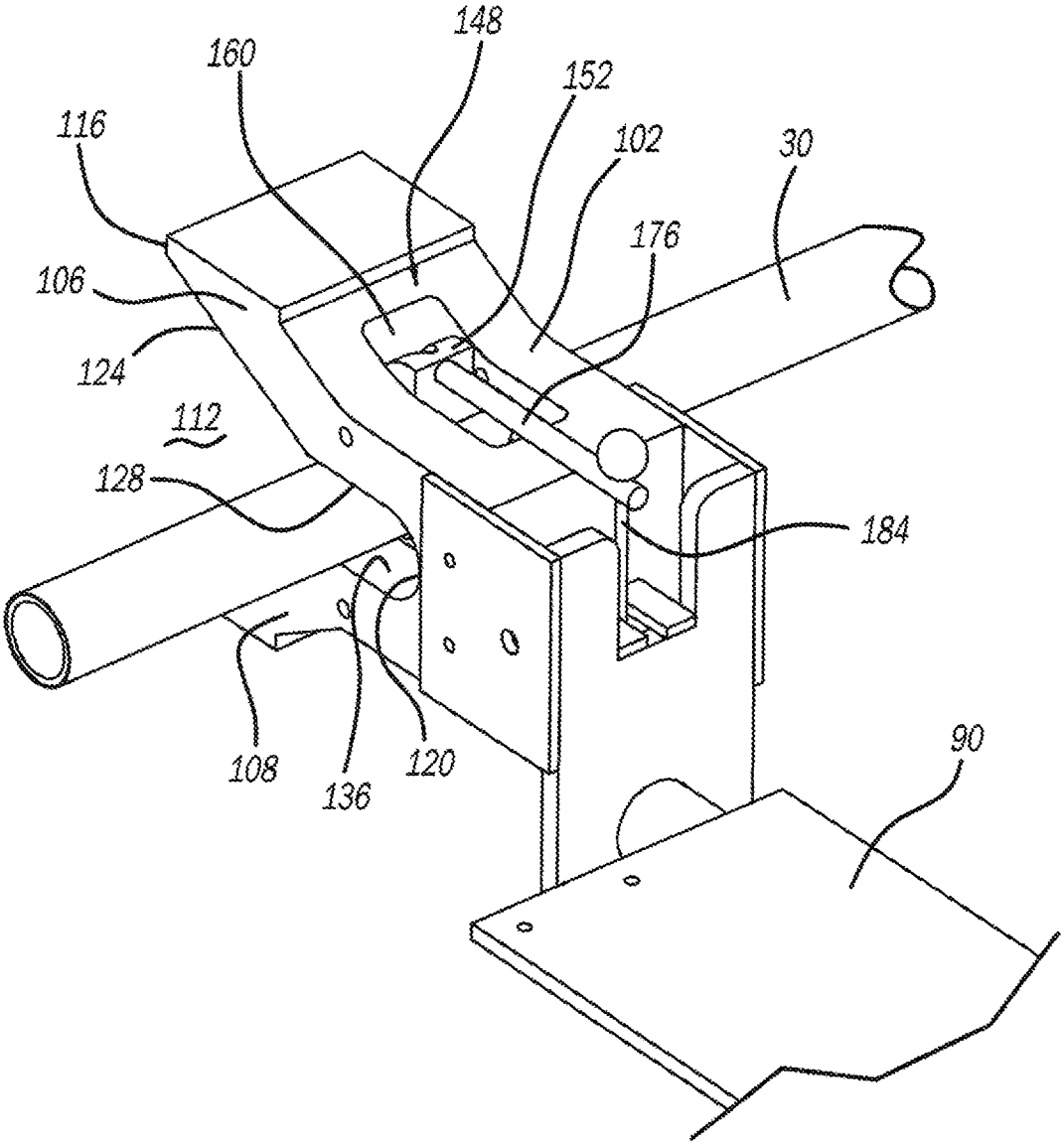
FIG. 4 is a schematic, perspective view of a hitch that forms part of the second portion of the docking system engaged with the horizontal shaft.
Figure 5:
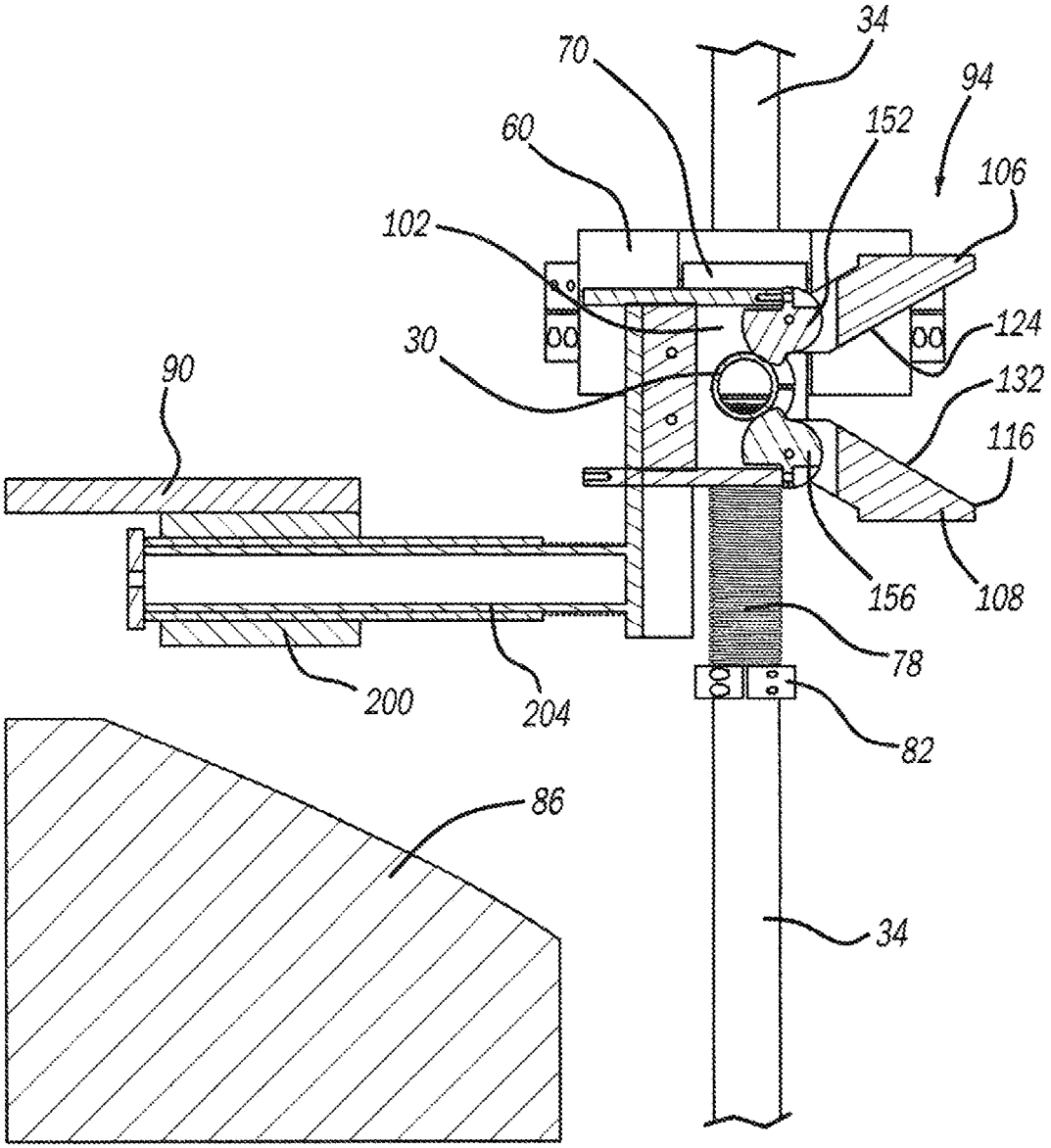
FIG. 5 is a schematic, cross-sectional, side view of the docking system with the hitch engaged with the horizontal shaft.
Figure 6:
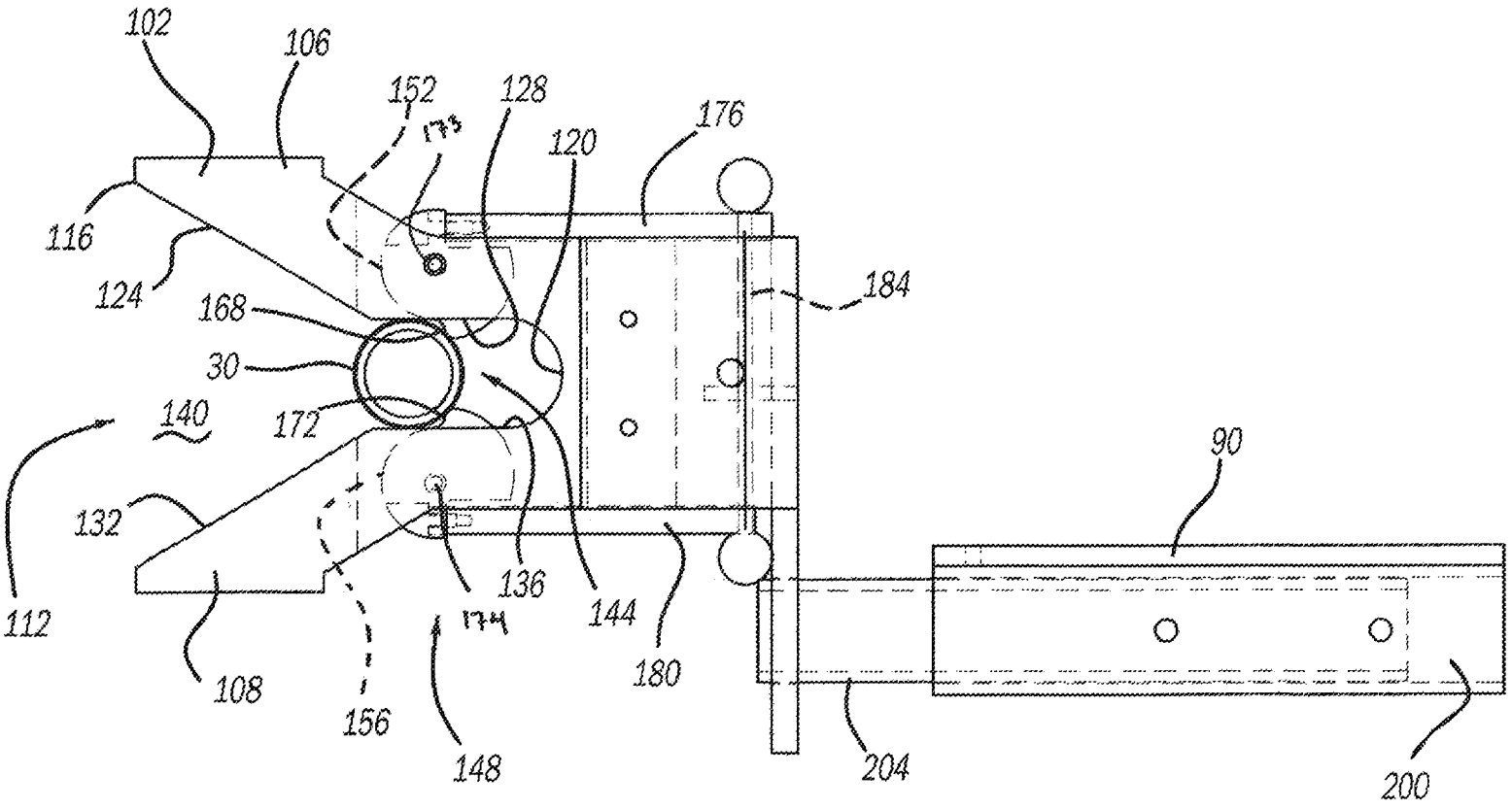
FIG. 6 is a schematic, side view of the hitch with the shaft in a first position during the process of engagement.

The second portion 22 of the docking system 10 is mounted to the boat 14 and is configured to automatically engage the shaft 30 with sufficient forward momentum of the boat 14, thereby securing the boat 14 relative to the seawall 26 as shown in FIG. 3. Referring specifically to FIGS. 3-5, the boat 14 in the embodiment depicted is a pontoon boat, including two pontoons 86 operatively connected to, and supporting, decking 90 as understood by those skilled in the art. Only a portion of the boat 14 is shown in the Figures. Those skilled in the art will recognize other components that may comprise a pontoon boat, including, but not limited to, a motor operatively connected to a propeller, seats for occupants, etc. The second portion 22 of the system 10 includes two hitches 94 that are mounted to the boat 14 such that the hitches 94 are positioned slightly forward of the bow 98 of the boat 14.

The two hitches 94 are substantially identical to one another in the embodiment depicted. Referring to FIGS. 4-8, each hitch 94 includes a respective housing or body 102 having a first arm 106 and a second arm 108. The first arm 106 and the second arm 108 cooperate to define a recess 112 therebetween. The recess 112 has an opening 116 and terminal end 120. The first arm 106 has a first surface portion 124 and a second surface portion 128. The second arm 108 has a third surface portion 132 and a fourth surface portion 136.

The first and third surface portions 124, 132 cooperate to define a first segment 140 of the recess 112 therebetween. The second and fourth surface portions 128, 136 are substantially parallel to one another and define a second segment 144 of the recess 112 therebetween. The first segment 140 of the recess 112 extends from the opening 116 to the second segment 144 and is tapered such that the recess 112 is widest at the opening 116.

The width of the second segment 144, i.e., the distance between the second surface portion 128 and the fourth surface portion 136, is slightly larger than the diameter of the shaft 30. The terminal end 120 of the recess 112 in the embodiment depicted is semi-cylindrical and is adjacent to, and contiguous with, the second segment 144.

Each hitch 94 includes a latching mechanism 148 that is configured to automatically retain the shaft 30 within the body 102 when the shaft 30 passes through the second segment 144 of the recess 112. In the embodiment depicted, the latching mechanism 148 is a cam lock system. More specifically, the latching mechanism includes a first member 152 and a second member 156.

The first member 152 is rotatably mounted to the first arm 106, such as via a pivot pin, within a first aperture 160 that extends through the first arm 106, including surface portion 128. The second member 156 is rotatably mounted to the second arm 108, such as via a pivot pin, within a second aperture 164 that extends through the second arm 108, including surface portion 136. The first member 152 is a cam with a notch cut out to form a substantially planar surface 168. The second member 156 is likewise a cam with a notch cut out to form a substantially planar surface 172.

Figure 7:
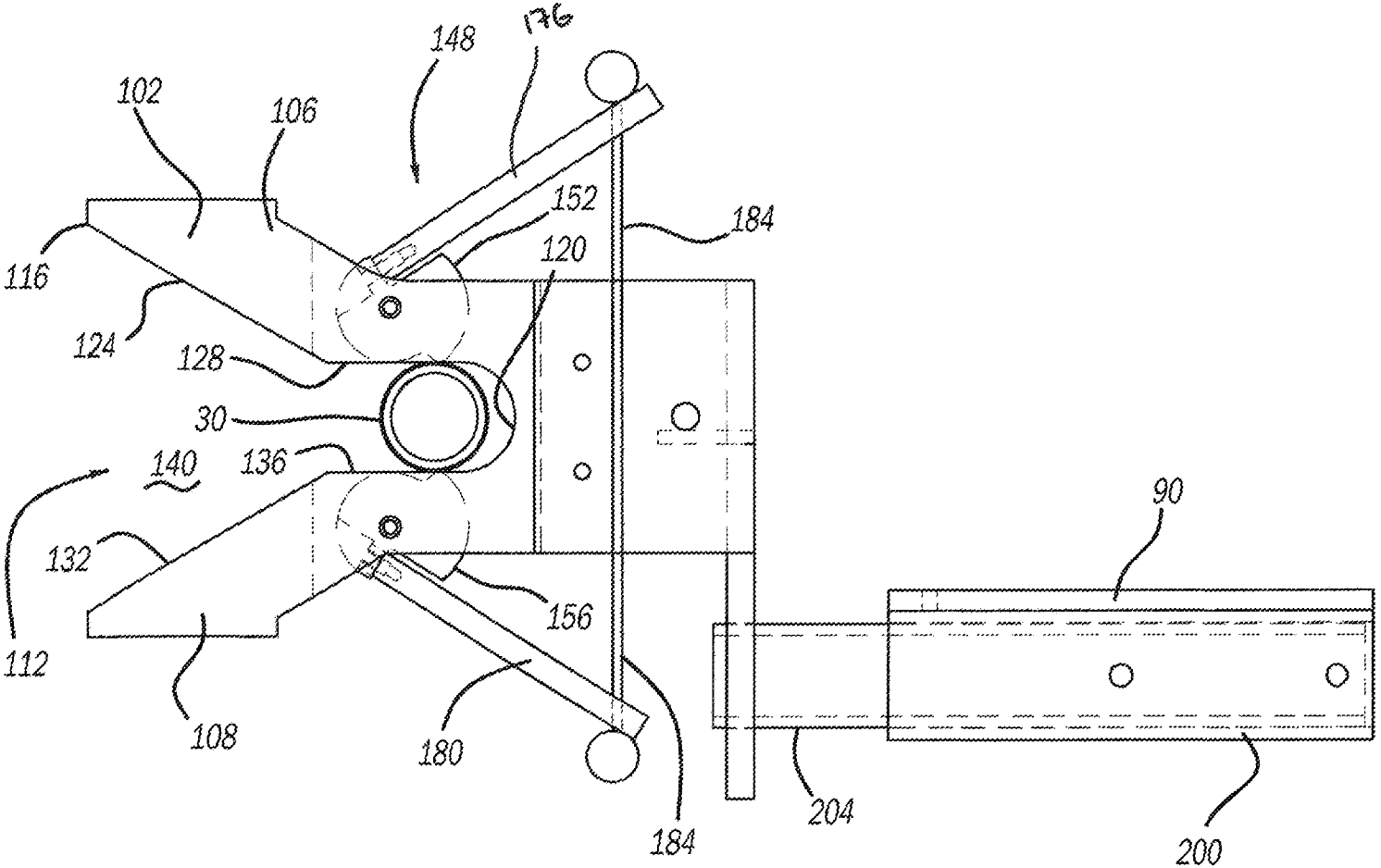
FIG. 7 is a schematic, side view of the hitch with the shaft in a second position during the process of engagement.

The first and second members 152, 156 are selectively rotatable relative to the body 102 between respective locking positions, as shown in FIGS. 5, 6 and 8-9, and unlocking positions, as shown in FIG. 7. More specifically, member 152 is rotatable relative to the body 102 about a first axis 173 and member 156 is rotatable relative to the body 102 about a second axis 174. When the first and second members 152, 156 are in their respective locking positions, the members 152, 156, including surfaces 168, 172 extend into the second segment 144 of the recess 112, thereby at least partially obstructing the recess 112. More specifically, member 152 extends downward past surface portion 128 such that surface 168 is at least partially within the recess 112 and faces generally toward the opening 116 of the recess. Similarly, member 156 extends upward past surface portion 136 such that surface 172 is at least partially within the recess 112 and faces generally toward the opening 116 of the recess. When the members 152, 156 are in their respective locking positions, the minimum distance between the members 152, 156 is less than the diameter of the shaft 30.

The latching mechanism also includes a first rod 176 and a second rod 180. The first rod 176 is mounted to the first member 152 and the second rod 180 is mounted to the second member 156. When the first and second members 152, 156 are in their respective locking positions, the rods 176, 180 contact the body 102, thereby preventing the rotation of the members 152, 156 in one respective rotational direction.

The rods 176, 180 are interconnected by a spring 184 at their respective ends. In one embodiment, the spring 184 is an elastomeric strip or cord, such as a bungee, though the spring 184 may also have other configurations within the scope of the claimed invention. The spring 184 urges the ends of the rods 176, 180 toward each other, thereby biasing the members 152, 156 in their respective locking positions.

When the members 152, 156 are in their respective unlocking positions, the members 152, 156 do not obstruct the recess 112, and the minimum distance between the members 152, 156 is greater than the diameter of the shaft 30, thereby permitting passage of the shaft 30 through the recess 112 and past the locking members 152, 156, as shown in FIG. 7. Movement of the members 152, 156 from the locking positions to the unlocking positions causes the ends of the rods 176, 180 to move apart from each other, thereby elastically deforming the spring 184.

To use the system 10 to dock or moor the boat 14, the boat 14 is maneuvered forward by the pilot of the boat 14 such that the shaft 30 enters the recess 112 via the opening 116. The tapering first segment 140 of the recess 112 provides a wide opening 116 to capture the shaft 30 within the recess 112. The surface portions 124, 132 will impart a force having a vertical component to the shaft 30, thereby urging the shaft 30 toward the center of the recess 112 as the shaft 30 moves relative to the body 14 toward the terminal end 120. As the boat 14 continues moving forward, the shaft 30 contacts surfaces 168, 172, thereby urging the members 152, 156 to rotate from their respective locking positions to their respective unlocking positions, as shown in FIG. 7.

Figure 8:
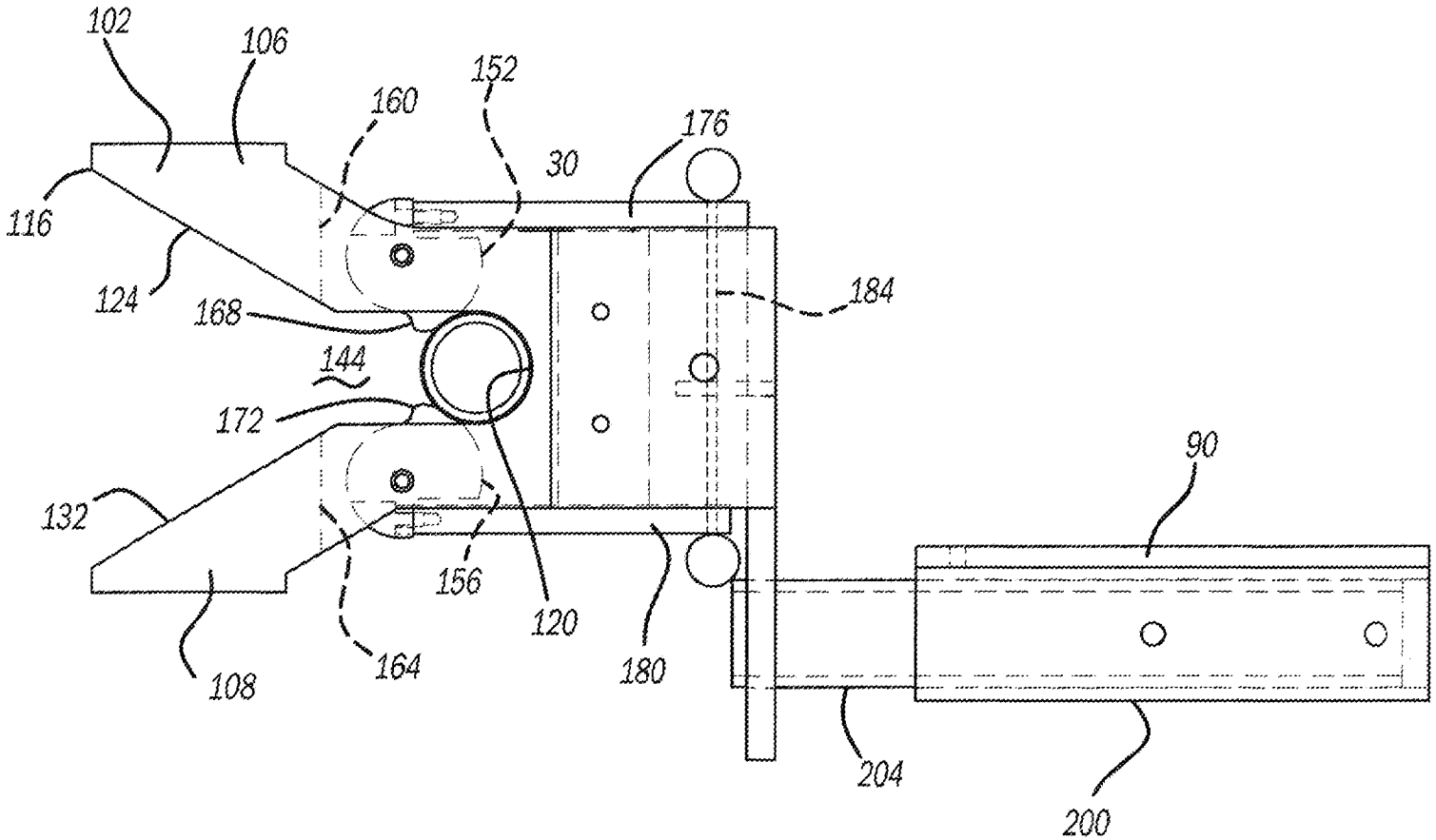
FIG. 8 is a schematic, side view of the hitch with the shaft in a third, fully engaged position.

With the members 152, 156 in their unlocking positions, there is sufficient space between the members 152, 156 for the shaft 30 to pass the members 152, 156 and touch the terminal end 120 of the recess 112. Once the shaft 30 has passed the members 152, 156, the spring 184 causes the members 152, 156 to return to their locking positions, thereby capturing the shaft 30 within the recess 112, as shown in FIGS. 8 and 9, and, correspondingly, connecting the boat 14 to the shaft 30, as shown in FIG. 3.

To release the boat 14 from the shaft 30, the rods 176, 180 may be manually pulled apart, or the system may include an electric actuator or air cylinder to overcome the bias of the spring 184 and move the members 152, 156 to their unlocked positions to permit travel of the shaft 30 out of the recess 112 and release the boat 14.

In the embodiment depicted, the boat 14 has two cylindrical receivers 200 mounted to the lower surface of the deck 90. Each hitch 94 has a respective cylindrical tube 204 that extends into a respective one of the receivers 200 to fasten the hitches 94 to the deck 90.

Figure 9:
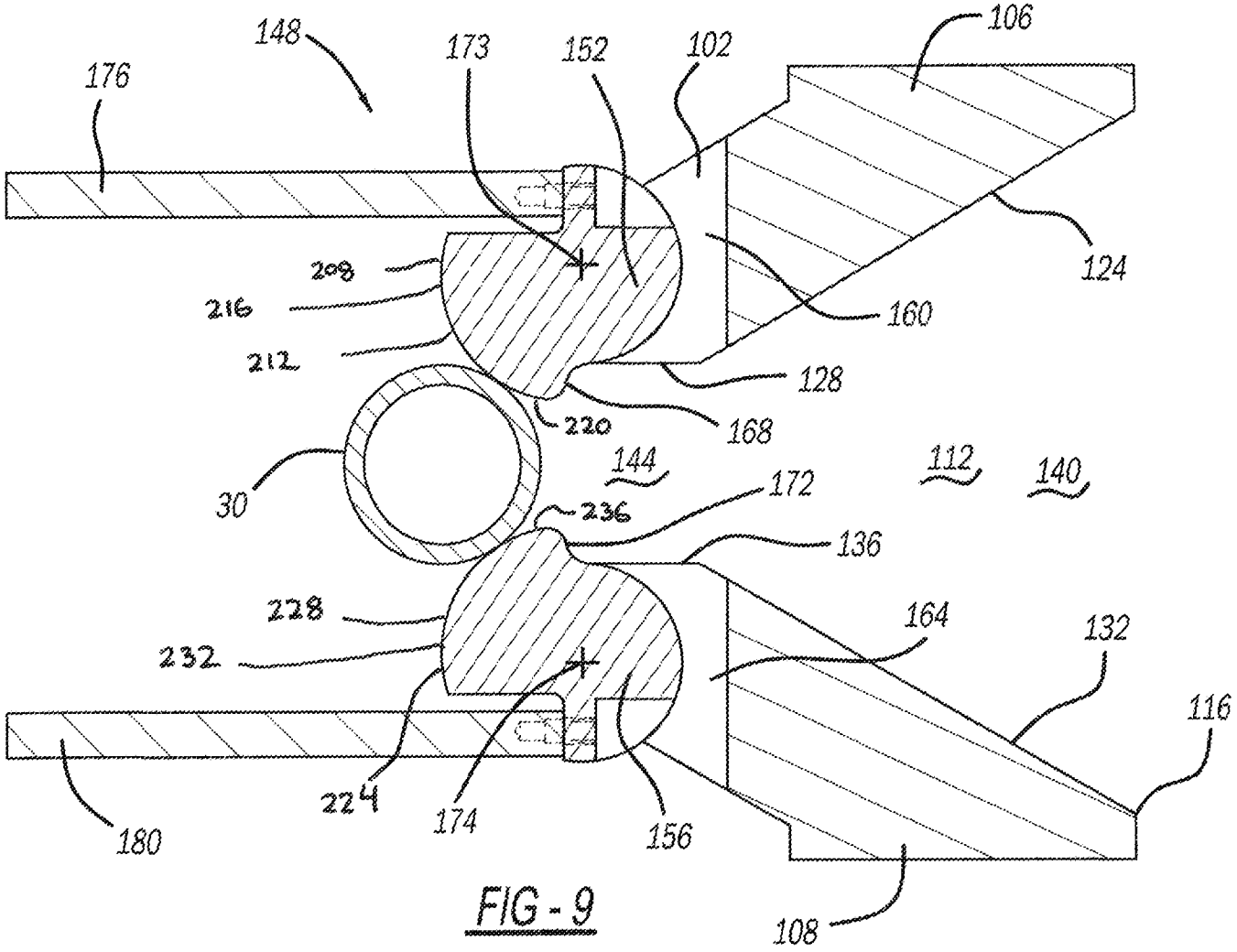
FIG. 9 is a schematic, cross-sectional side view of the hitch engaged with the horizontal shaft.

As best seen in FIG. 9, wherein like reference numbers refer to like components from FIGS. 1-8, the first member 152 has a peripheral surface 208, which includes planar surface 168 and an eccentric portion 212, which is adjacent to the planar surface 168. The eccentric portion 212 is eccentric relative to the axis of the rotation 173 of the member 152, i.e., for points on the eccentric portion 212, distance to the axis 173 increases with angular distance from the planar surface 168. Thus, for example, the distance between the axis 173 and point 216 is greater than the distance between the axis 173 and point 220. In the embodiment depicted, this is achieved by eccentric portion 212 being an arc of a circle having a center that is not at axis 173.

Similarly, the second member 156 has a peripheral surface 224, which includes planar surface 172 and an eccentric portion 228, which is adjacent to the planar surface 172. The eccentric portion 228 is eccentric relative to the axis of the rotation 174 of the member 156, i.e., for points on the eccentric portion 228, distance to the axis 174 increases with angular distance from the planar surface 172. Thus, for example, the distance between the axis 174 and point 232 is greater than the distance between the axis 174 and point 236. In the embodiment depicted, this is achieved by eccentric portion 228 being an arc of a circle having a center that is not at axis 174.

The eccentric portions 212, 218 are positioned on their respective members 152, 156 such that at least part of each eccentric portion 212, 218 extends into the second segment 144 of the recess 112, into the travel path of the shaft 30, and generally face toward the terminal end 120, when the members 152, 156 are in their locking positions. The eccentric portions 212, 228 are positioned and configured to contact the shaft 30 when the shaft 30 is in a locked position relative to the body 102, as shown in FIGS. 8 and 9. More specifically, when the shaft 30 is in the locked position, the body 102 at the terminal end 120, the second surface portion 128, and the fourth surface portion 136 prevents any movement of the shaft 30 relative to the body 102 in three directions, i.e., two vertical directions and rearward relative to the boat 14. The eccentric portions 212, 228 also contact the shaft 30 when the shaft 30 is in the locked position, thereby preventing movement of the shaft 30 in the forward direction relative to the boat 14. The eccentric portions 212, 228 are particularly effective in preventing any relative movement between the shaft 30 and the body 102, because the eccentricity results in a clamping action on the shaft 30.

It should be noted that, although each of the hitches 94 includes two members 152, 156, a hitch may include only a single one of members 152, 156 within the scope of the claimed invention.

Figure 10:
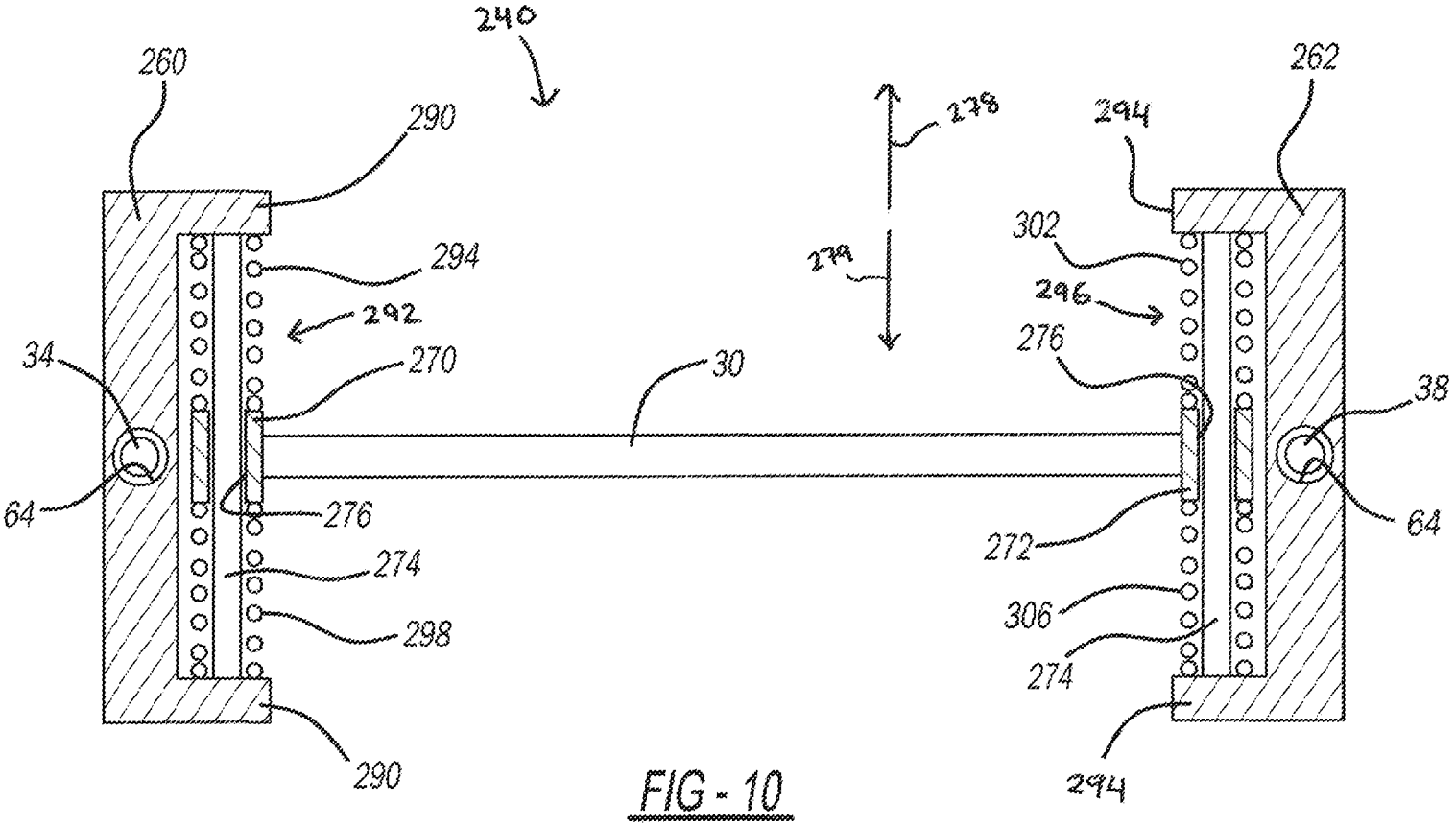
FIG. 10 is a schematic, sectional, top view of an alternative first portion within the scope of the claimed invention.

Referring to FIG. 10, wherein like reference numbers refer to like component from FIGS. 1-9, an alternative first portion 240 of the system 10 is schematically depicted. The first portion 240 is identical to the first portion shown at 18 in FIG. 1 except for the interconnection of the shaft 30 with the supports 34, 38. More specifically, block 260 defines hole 64, through which support 34 extends. Similarly, block 262 defines hole 64, through which support 38 extends. Thus, blocks 260, 262 are slidable along supports 34, 38 and are biased by springs (shown at 78 in FIG. 1) and supported by members (shown at 82 in FIG. 1).

Block 260 is generally C-shaped, and includes two parallel arms 290 that define an open space 292 therebetween. A shaft 274 is mounted to the two arms 290 and extends across the open space 292. Block 270 defines hole 276. Shaft 274 extends through hole 276 so that block 270 is slidable along the shaft 274 in a first horizontal direction 278 and a second horizontal direction 279 opposite the first horizontal direction 278.

Similarly, block 262 is generally C-shaped, and includes two parallel arms 294 that define an open space 296 therebetween. Another shaft 274 is mounted to the two arms 294 and extends across the open space 296. Block 272 defines hole 276. Shaft 274 extends through hole 276 so that block 272 is slidable along the shaft 274 in the first horizontal direction 278 and the second horizontal direction 279.

Shaft 30 is mounted to blocks 270 and 272. Accordingly, shaft 30 is movable with the blocks 270, 272 in the first and second directions 278, 279. It should be noted that movement of the shaft 30 is limited to up and down and the two opposite horizontal directions 278, 279. Accordingly, the shaft 30 is mounted with respect to the seawall 26 and is permitted limited movement by the first portion 240.

Vertical movement of the shaft 30 enables engagement of the shaft 30 with hitches 94 that are not perfectly aligned with the default vertical position of the shaft 30. A first spring 294 is between one of the arms 290 and block 270 and biases the block 270 in the second direction 279. A second spring 298 is between the other of the arms 290 and the block 270 and biases the block 270 in the first direction 278. Similarly, a third spring 302 is between one of the arms 294 and block 272 and biases the block 272 in the second direction 279. A fourth spring 306 is between the other of the arms 294 and block 272 and biases the block 272 in the first direction. When the hitches 94 engage the shaft 30, the impact urges the shaft in the first direction 278.

The springs 294, 298, 302, 306 reduce the impact force and return the shaft 30 to a midpoint relative to the shafts 274. The arms 290, 294 provide limits to the amount of movement of the shaft 30 in the first and second directions 278, 279. Thus, the possible movement of the shaft 30 in the first and second directions 278, 279 is limited to a predetermined range.

It should be noted that other configurations of the first portion that connect the shaft 30 to a stationary structure or land feature while limiting movement of the shaft 30 to vertical movement and a range of horizontal movement in first and second directions may be employed within the scope of the claimed invention. For example, and without limitation, support members 34, 38 may not extend to the bed 42 but may instead be supported by floats or buoys.

While the best modes for carrying out the invention have been described in detail, those familiar with the art to which this invention relates will recognize various alternative designs and embodiments for practicing the invention within the scope of the appended claims.

The invention claimed is:

1. A system for docking or mooring a boat relative to a structure or landform, the system comprising:
- a docking assembly having a cylindrical shaft mounted with respect to the structure or landform such that movement of the cylindrical shaft is substantially limited to movement up and down, in a first horizontal direction, and a second horizontal direction opposite the first horizontal direction;
- a hitch assembly mounted with respect to the boat and having a body and a latching system;
- said body having a first arm and a second arm defining a recess therebetween, said recess having an opening;
- said latching system including a cam member being rotatably connected to the body and being selectively rotatable about an axis between a first position and a second position;
- wherein the cam member extends further into the recess in the first position than in the second position;
- said hitch being positioned relative to the boat such that forward movement of the boat in the direction of the shaft causes the shaft to enter the recess, contact the cam member and thereby cause the cam member to move from the first position to the second position.

2. The system of claim 1, wherein the body defines a terminal end of the recess;
- wherein the latching system includes a spring that biases the cam member in the first position; and
- wherein the cam member is positioned to contact the shaft when the shaft is at the terminal end of the recess.

3. The system of claim 2, wherein the cam member has a peripheral surface that includes a generally planar segment and an eccentric segment; and
- wherein the generally planar segment generally faces the opening when the cam member is in the first position; and
- wherein the eccentric segment generally faces the terminal end when the cam member is in the first position.

4. The system of claim 3, wherein the eccentric segment is positioned to contact the shaft when the shaft is at the terminal end of the recess and the cam member is in the first position.

5. The system of claim 3, wherein the first arm defines a first surface portion and a second surface portion;
- wherein the second arm defines a third surface portion and a fourth surface portion;
- wherein the first and third surface portions define a first segment of the recess therebetween; and
- wherein the second and fourth surface portions are parallel to one another and define a second segment of the recess therebetween;
- wherein the first segment extends from the opening of the recess to the second segment of the recess; and
- wherein the first segment is tapered such that the recess is widest at the opening.

6. A hitch assembly comprising:
- a body having first and second arms cooperating to define a recess therebetween, said recess having an opening and a terminal end;
- a cam member being rotatably mounted with respect to the first arm and being selectively rotatable relative to the body about an axis between a first position and a second position;
- wherein the cam member has a peripheral surface with a generally planar segment and an eccentric segment;
- wherein the planar segment and the eccentric segment extend further into the recess when the cam member is in the first position than when the cam member is in the second position; and
- wherein the generally planar segment generally faces the opening and the eccentric segment generally faces the terminal end when the cam member is in the first position.

7. The hitch assembly of claim 6, further comprising a spring operatively connected to the cam member to bias the cam member in the first position.

8. The hitch assembly of claim 7, wherein the body is configured such that the recess includes a tapered segment such that the recess is widest at the opening.

* * * * *